United States Patent [19]

D'Urso

[11] 4,065,882

[45] Jan. 3, 1978

[54] GRINDING TOOL FITTED WITH AN ABRASIVE SHEET HAVING ACTIVE FACE AND EDGE SURFACES

[76] Inventor: Giuseppe D'Urso, Viale Strasburgo, 253, 90100 Palermo, Italy

[21] Appl. No.: 710,729

[22] Filed: Aug. 2, 1976

[30] Foreign Application Priority Data

Sept. 4, 1975 Italy ..... 26926/75

[51] Int. Cl.[2] ..... B24D 9/08

[52] U.S. Cl. ..... 51/381

[58] Field of Search ..... 51/358, 376, 379, 380, 51/381, 382, 383, 275, 398

[56] References Cited

U.S. PATENT DOCUMENTS

| | | | |
|---|---|---|---|
| 505,644 | 9/1893 | Webster | 51/381 |
| 1,659,684 | 2/1928 | Field | 51/381 |
| 1,778,470 | 10/1930 | Stratford | 51/379 |
| 2,119,738 | 6/1938 | Dempsey | 51/380 X |
| 2,127,703 | 8/1938 | Schwenke | 51/381 |
| 3,416,265 | 12/1968 | Marton | 51/381 |

FOREIGN PATENT DOCUMENTS

| | | | |
|---|---|---|---|
| 249,656 | 4/1926 | United Kingdom | 51/379 |

*Primary Examiner*—Al Lawrence Smith
*Assistant Examiner*—Nicholas P. Godici
*Attorney, Agent, or Firm*—Bacon & Thomas

[57] ABSTRACT

Grinding tool comprising a support or carrier with associated relatively resilient pad covered by a removable abrasive sheet, wherein said abrasive sheet has a central zone forming an active face and a marginal zone with removed portions bent over or folded against the tool edge without forming any folds or wrinkles and without any discontinuities adjacent the central zone forming an active corner or edge. Preferably, the tool is of frusto-conical shape.

8 Claims, 5 Drawing Figures

GRINDING TOOL FITTED WITH AN ABRASIVE SHEET HAVING ACTIVE FACE AND EDGE SURFACES

Figure 1C:
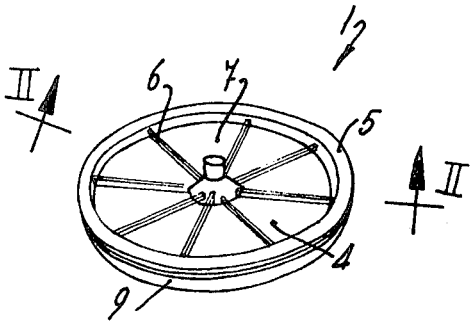

This invention is concerned with a grinding or lapping tool, of the type including a support or carrier having an "emery cloth" secured or attached thereto. By the term "emery cloth" herein is meant a sheet of paper or other relatively flexible material provided on one of its faces with emery powder or other abrasive granular material.

Grinding tools of the type at present known have the support or carrier provided with a flat face, to which the emery cloth is attached by means of glue or cement, so that such a tool has an active face, but the edge defining such a face is inactive, thus being capable of carrying out a well defined grinding operation. Moreover, in such known tools, the emery cloth would tend on wearing out to come off to pieces and should be completely scraped away if desiring to reuse the support or carrier with a new emery cloth, which operation is time consuming and accordingly expensive. Finally, the application of the emery cloth to the support or carrier should be accurately effected in order to prevent the emery cloth from adhering unevenly to the support or carrier and thus forming air bubbles in the adhesive, which would adversely affect the life of the emery cloth.

In order to overcome the above mentioned disadvantages, it was necessary to resort to rather complex and particular devices and fittings, assuring an improved application of the emery cloth to the support or carrier, but weighing heavily on the production cost of the grinding tools. Additionally, such tools have only one active face, and accordingly have a limited working elasticity or versatility.

It is the primary object of the present invention to overcome all of the disadvantages inherent in the prior art grinding tools by simply and economically providing a tool affording easy replacement of the emery cloth and having around the active face an active corner and edge enabling more diversified utilization of the grinding tool.

According to the invention, a grinding or abrasive tool comprises a support or carrier having a relatively resilient pad at the active face; a sheet of emery cloth having a central portion or zone forming the active face and an edge zone for bending against the support or carrier edge; and means for firmly clamping the edge zone of the emery cloth sheet against the support or carrier edge, the portion of the edge of emery cloth sheet adjacent the active face being left exposed.

Also the sheet of emery cloth for use in such a grinding tool is within the scope of the present invention and comprises a central zone of a magnitude corresponding to the active face and a marginal or edge zone for bending relative to the plane of said active face, forming an active corner or edge and having a limb or edge for attachment to the support or carrier.

Finally, the present invention is also concerned with a process of making and assembling such a grinding tool, and cosisting of providing a support or carrier, preferably by moulding, and applying thereto a rubber pad or the like at the active face; blanking or die cutting a sheet of emery cloth with a marginal or edge zone having removed zones to avoid folds in the emery cloth sheet when the edge is bent over relative to the plane of said active face; and firmly attaching the bent over edge of the emery cloth sheet to said support or carrier.

Figure 1B:
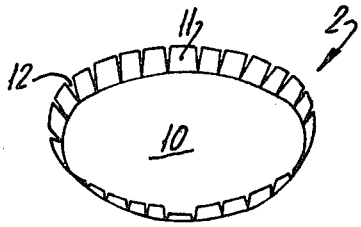
Figure 1A:
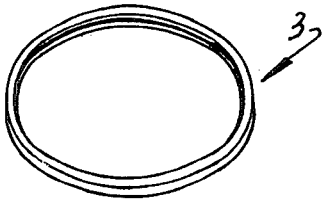
Figure 3:
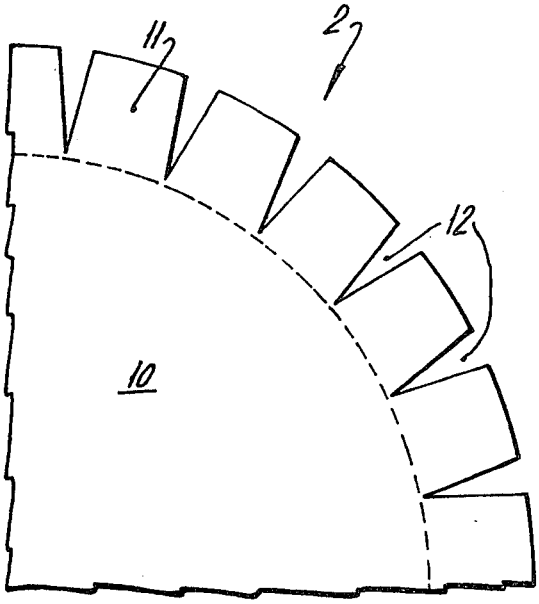
Figure 2:
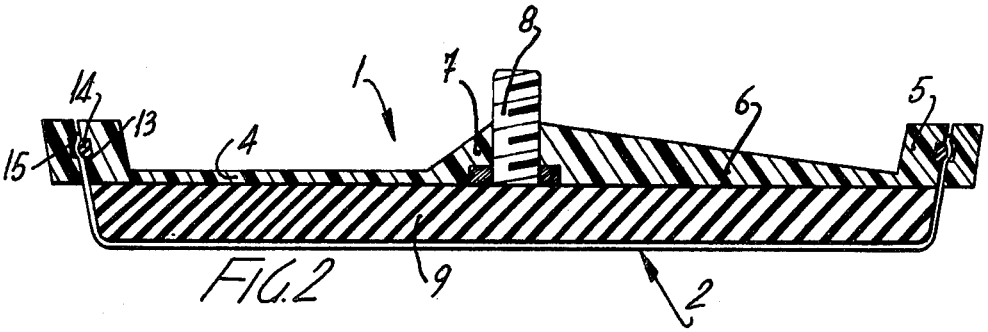

Further features and advantages of the invention will become more apparent from the following detailed description, reference being had to the accompanying drawings as an illustrative example of the invention, and in which:

FIGS. 1*a*–1*c* are exploded perspective views of an embodiment of the present invention;

FIG. 2 is an enlarged sectional view taken along line II—II of FIG. 1*c*, showing the grinding tool in assembled condition; and FIG. 3 is an enlarged detail view of the emery cloth sheet used in the embodiment as shown in FIGS. 1*a*–1*c* and 2.

In the drawings and associated description, reference is made to a disc grinding tool, which is the most conventional type of such tools, however it is apparent that the expedients according to the present invention can be adopted for providing grinding tools of any shape by suitably modifying the component parts, as will be readily appreciated by those skilled in the art, and therefore not requiring further explanations herein.

As shown, a grinding tool comprises a disc support or carrier 1, having attached thereto a pad 9 made of rubber or like material, a sheet of emery cloth 2 covering said pad 9 and the edge of abrasive sheet 2 against the edge of support or carrier 1. Preferably, said disc support or carrier 1 comprises a moulding of rigid plastic material shaped to have a bottom 4 with raised marginal edge 5, stiffening spokes or ribs 6, and a sturdier central portion 7 carrying a central bolt 8 for attachment to a machine tool supplying the rotary motion for tool driving. Preferably, the assembly comprising said support or carrier 1 and pad 9 is of frusto-conical profile. Stop ring 3 is also preferably made of plastic material, which can be the same material as that used for support or carrier 1, and the inner profile of which has the same tapering as support or carrier 1. Emery cloth sheet 2 comprises a central zone 10 of the same shape and size as the active face, and a marginal zone 11, from which triangular portions 12 have been removed, such portions being calculated so that when marginal zone 11 is bent over relative to the plane of active face 10, with a slope corresponding to the tapering of support or carrier 1 and pad 9, there will be formed a border or band which is substantially continuous and foldless or without any other deformations of the material. At the attachment limb or edge between edge 5 of support or carrier 1 and stop ring 3, said band or border could also have discontinuities, continuity being essential in the exposed portion, adjacent active face 10 and forming an active or grinding corner or edge. For an improved fastening of the component parts, the outer profile of support or carrier 1 has an annular notch 13, wherein an O-ring 14 is accomodated, and the inner profile of stop ring 3 has a corresponding annular notch 15, so that the edge of emery cloth sheet 2 warps and makes secure engagement without risk of accidentally slipping off.

The grinding tool of the invention is assembled as follows:

Emery cloth sheet 2 is first placed in centered relation on stop ring 3, and then support or carrier 1 is put on the central zone of said emery cloth sheet 2 with pad 9 bearing on emery cloth sheet 2, then a pull action is exerted on stop ring 3 to bring it against edge 5 of support or carrier 1, with a resulting folding of marginal zone 11 of said emery cloth sheet 2 relative to the plane of active face 10, which remains adhering to pad 9. Movement of stop ring 3 relative to support or carrier 1 and associated pad 9 is facilitated and guided by the tapering between such parts. Also folding of emery cloth sheet 2 is aided by tapering of pad 9 with edge radiused to the base. When annular notch 15 of stop ring 3 is opposite to annular notch 13 of edge 5 of support or carrier 1, said O-ring 14 will snap into notch 15 of stop ring 3 and clamp the parts together, retaining the edge of emery cloth sheet 2 therebetween.

After wearing out of the emery cloth sheet, stop ring 3 can be slipped off from support or carrier 1 by imparting a slight pressure or push thereto, so that emery cloth sheet 2 is completely separated from the support or carrier and can be replaced by a new emery cloth sheet, repeating the above described assembling operation.

As shown in FIG. 2, the grinding tool has a flat active face, as ordinary grinding tools, however it also has an active border or band on the edge also pressing on pad 9, thus affording a much wider working range (grinding, lapping or finishing) than hitherto attainable by prior art tools.

It should be noted that stop ring 3 can be replaced by other removable clamping means enabling one to attach the edge of emery cloth sheet 2, while leaving exposed the band or border of the edge adjacent the active face.

Of course, the principle of the invention being unaltered, both the construction details and embodiments can be widely varied with respect to the matter herein described and shown, without departing from the scope of the present invention.

What I claim is:

1. A rotary abrasive tool comprising:

a rotary support having a substantially flat circular lower face and a peripheral edge;

a resilient circular pad overlying said flat face and having a flat working face on the bottom thereof and a peripheral edge of substantial width;

a sheet of abrasive coated material overlying said working face and having a multiplicity of edge tabs extending upwardly over said peripheral edges, said edge tabs being configured and arranged to lie against said peripheral edge in mutual edge-abutting relation to thereby define a smooth and continuous abrasive edge surface for said tool; and means releasably securing only the upper ends of said tabs to the peripheral edge of said support.

2. An abrasive tool as defined in claim 1 wherein said tabs are integral with said sheet and are defined by V-shaped notches in the edge portion of said sheet, the apices of said notches being substantially coincident with the periphery of said working face.

3. An abrasive tool as defined in claim 2 wherein said tabs are of truncated triangular shape, tapering outwardly.

4. An abrasive tool as defined in claim 1 wherein said peripheral edges define a downwardly tapering frustoconical surface.

5. An abrasive tool as defined in claim 4 wherein said last-named means comprises a substantially rigid ring wedgingly clamping the upper ends of said tabs against the peripheral edge of said rotary support.

6. An abrasive tool as defined in claim 5 including a circumferential groove in the peripheral edge of said rotary support, a resilient ring in said groove and extending outwardly therefrom, said rigid ring pressing said tabs against said resilient ring.

7. An abrasive tool as defined in claim 6 including a peripheral groove on the inner periphery of said rigid ring opposite said resilient ring.

8. An abrasive tool as defined in claim 1 wherein said rotary support comprises a flat disc having stiffening ribs on its upper surface, its peripheral edge being defined by an upstanding peripheral flange.

* * * * *